US007264537B1

(12) United States Patent
Laursen et al.

(10) Patent No.: US 7,264,537 B1
(45) Date of Patent: Sep. 4, 2007

(54) METHODS FOR MONITORING A CHEMICAL MECHANICAL PLANARIZATION PROCESS OF A METAL LAYER USING AN IN-SITU EDDY CURRENT MEASURING SYSTEM

(75) Inventors: Thomas Laursen, New Haven, CT (US); Karl Kasprzyk, Gilbert, AZ (US); Steven Reynolds, Chandler, AZ (US); Paul Franzen, Gilbert, AZ (US); Justin Quarantello, Higley, AZ (US)

(73) Assignee: Novellus Systems, Inc., San Jose, CA (US)

( * ) Notice: Subject to any disclaimer, the term of this patent is extended or adjusted under 35 U.S.C. 154(b) by 59 days.

(21) Appl. No.: 11/499,443

(22) Filed: Aug. 4, 2006 (Under 37 CFR 1.47)

(51) Int. Cl.
*B24B 49/12* (2006.01)

(52) U.S. Cl. ..... 451/8; 451/6; 451/41

(58) Field of Classification Search ..... 451/5, 451/6, 8, 41, 285–290, 24, 53
See application file for complete search history.

(56) References Cited

U.S. PATENT DOCUMENTS 5,433,651 A * 7/1995 Lustig et al. ..... 451/6
5,700,180 A * 12/1997 Sandhu et al. ..... 451/5
5,838,447 A * 11/1998 Hiyama et al. ..... 356/600
6,106,662 A * 8/2000 Bibby et al. ..... 156/345.13
6,923,711 B2 8/2005 Laursen et al.
6,960,115 B2 11/2005 Weldon et al.
6,991,514 B1 1/2006 Meloni et al.

* cited by examiner

*Primary Examiner*—Lee Wilson
*Assistant Examiner*—Anthony Ojini
(74) *Attorney, Agent, or Firm*—Ingrassia, Fisher & Lorenz, P.C.

(57) ABSTRACT

Methods are provided for monitoring a CMP process. An exemplary method comprises generating a plurality of thickness measurements of a metal layer using an in-situ eddy current measuring system. The thickness measurements are analyzed to derive a plurality of work piece metrics and the work piece metrics are assessed to determine if a predetermined number is within a predetermined specification. A signal is generated if the predetermined number of the work piece metrics is outside the predetermined specification.

21 Claims, 3 Drawing Sheets

METHODS FOR MONITORING A CHEMICAL MECHANICAL PLANARIZATION PROCESS OF A METAL LAYER USING AN IN-SITU EDDY CURRENT MEASURING SYSTEM

FIELD OF THE INVENTION

The present invention generally relates to chemical mechanical planarization, and more particularly relates to methods for monitoring chemical mechanical planarization processes using in-situ eddy current measuring systems.

BACKGROUND OF THE INVENTION

The manufacture of many types of work pieces requires the substantial planarization of at least one surface of the work piece. Examples of such work pieces that require a planar surface include semiconductor wafers, optical blanks, memory disks, and the like. Without loss of generality, but for ease of description and understanding, the following description of the invention will focus on applications to only one specific type of work piece, namely a semiconductor wafer. The invention, however, is not to be interpreted as being applicable only to semiconductor wafers.

One commonly used technique for planarizing the surface of a work piece is the chemical mechanical planarization (CMP) process. In the CMP process a work piece, held by a work piece carrier, is pressed against a polishing surface in the presence of a polishing slurry, and relative motion (rotational, orbital, linear, or a combination of these) between the work piece and the polishing surface is initiated. The mechanical abrasion of the work piece surface combined with the chemical interaction of the slurry with the material on the work piece surface ideally produces a planar surface.

The construction of the carrier and the relative motion between the polishing pad and the carrier head have been extensively engineered in an attempt to achieve a uniform removal of metal across the surface of the work piece and hence to achieve the desired planar surface. However, as a CMP process proceeds, conditions or parameters of the process may change, slightly or dramatically, causing the process to "drift" away from providing a uniform work piece surface. In addition, the CMP process may change from work piece to work piece, or the work pieces themselves may vary enough from each other that achieving uniform removal or a uniform work piece surface on each work piece becomes difficult.

Accordingly, it is desirable to provide a method for monitoring the removal of a metal layer from work piece during a CMP process. It also is desirable to provide a method that generates a signal when the CMP process "drifts", either during the planarization of a work piece or from work piece to work piece to prevent misprocessed wafers. Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The present invention is directed to methods for monitoring the removal of a metal layer from a work piece during a chemical mechanical planarization (CMP) process. The methods utilize the monitoring of work piece metrics and a comparison of those metrics to predetermined specifications. If an assessment of the work piece metrics indicates that the CMP process has "drifted" out of a specification such that misprocessing of the work piece may occur, a signal is generated. The signal provides an opportunity for immediate correction during the CMP process or for correction prior to subsequent work piece processing.

The terms "planarization" and "polishing," or other forms of these words, although having different connotations, are often used interchangeably by those of skill in the art with the intended meaning conveyed by the context in which the term is used. In turn, the term "chemical mechanical planarization" is often referred to in the industry as "chemical mechanical polishing," and it is intended to encompass herein both terms by the use of "chemical mechanical planarization" and to represent each by the acronym "CMP". For purposes of illustration only, the invention will be described as it applies to a CMP apparatus and to a CMP process and specifically as it applies to the CMP processing of a semiconductor wafer. It is not intended, however, that the invention be limited to these illustrative embodiments; instead, the invention is applicable to a variety of processing apparatus, including electrochemical mechanical planarization (ECMP) and to the processing and handling of many types of work pieces.

Figure 1:
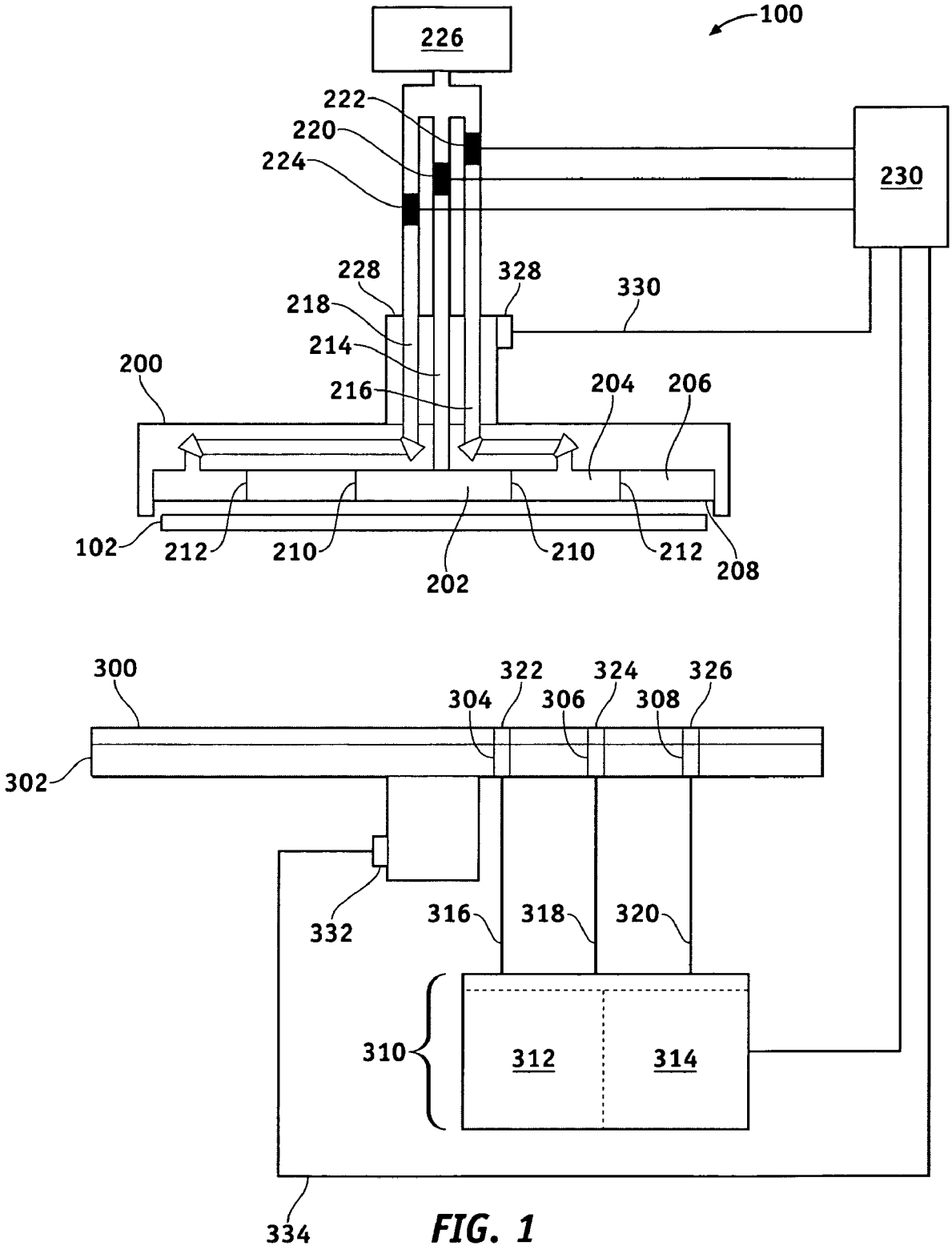
FIG. 1 (PRIOR ART)
FIG. 1 is a cross-sectional view of a CMP apparatus having an in-situ eddy current measuring system and adjustable pressure zones.

An example of a CMP apparatus 100 having an in-situ eddy current thickness-measuring system and multiple pressure chambers or zones (hereinafter "zones") is illustrated in FIG. 1. While CMP apparatus 100 is illustrated with a carrier having multiple pressure zones, it will be understood that the present invention is not limited to CMP apparatuses that have multiple pressure zones and that the CMP apparatus of FIG. 1 is provided for illustration purposes.

Figure 2:
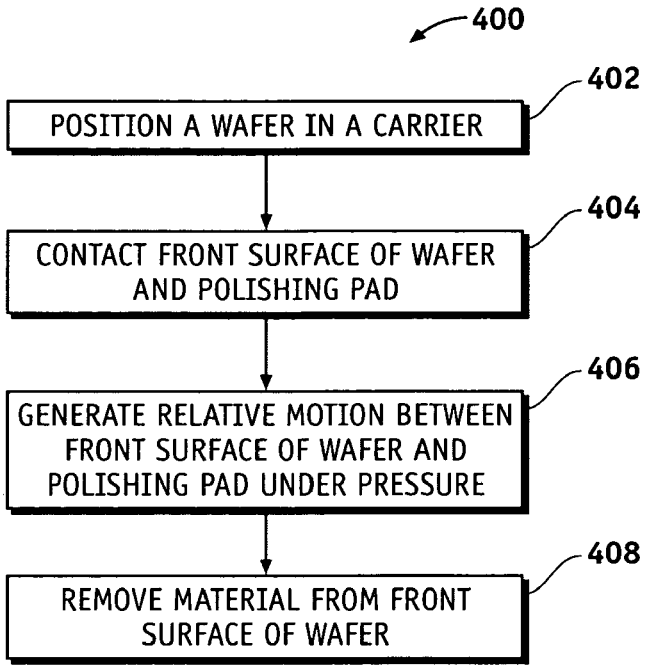
FIG. 2 (PRIOR ART)
FIG. 2 is a flow chart of a method for performing a conventional CMP.

A method 400 for performing a conventional CMP process is illustrated in FIG. 2. Referring to FIGS. 1 and 2, during a CMP process, a wafer 102 is positioned within a carrier 200 adjacent and substantially parallel to a working surface or polishing pad 300 (step 402). The wafer 102 is positioned so that the front surface of the wafer, that is, the surface from which the metal is to be removed, is exposed. The metal can be copper, aluminum, gold, silver, titanium, tantalum, or any other suitable metal used for semiconductor processing. Contact is made between the front surface of the wafer 102 and the polishing pad 300 fixed to a supporting surface 302, preferably in the presence of a polishing solution or slurry (not shown) (step 404). The front surface of the wafer 102 is planarized by generating relative motion between the front surface of the wafer 102 and the polishing pad 300 under pressure (step 406), thereby removing metal from the front surface of the wafer 102 (step 408).

The supporting surface 302 and polishing pad 300 may be moved rotationally, linearly, or preferably, orbitally. The carrier 200 is preferably rotated about its central axis as it presses the front surface of the wafer 102 against the polishing pad 300 during the planarization process. The carrier 200 may also be moved along the polishing pad 300 to enhance the planarization process of the wafer.

The CMP apparatus 100 also utilizes a plurality of probes 304, 306, and 308 positioned beneath the polishing pad 300. Probes 304, 306, 308 are sensor devices of a multi-probe eddy current thickness-measuring system 310. While three probes 304, 306, 308 are illustrated in FIG. 1, any suitable number of probes may be used. The greater the number of probes, the more complete scan of the wafer surface may generally be taken. Each probe 304, 306, 308 may be positioned to collect data points from a particular annular band on the front surface of the wafer. If an orbital CMP tool is used, each probe 304, 306, 308 may be used to monitor a single annular band. The annular bands in such an orbital CMP tool may be made to overlap to ensure the entire front surface of the wafer 102 is being monitored.

The multi-probe eddy current system 310 may include probes, i.e., 304, 306, and 308, a drive system 312 to induce eddy currents within a metal layer on the wafer 102 and a sensing system 314 to detect eddy currents induced in the metal layer by the drive system. Probes 304, 306, and 308 are activated by drive system 312 through cables 316, 318, 320, respectively. Eddy currents induced within a metal layer on the surface of the wafer 102 are sensed by the probes and signals are sent to the sensing system through cables 316, 318, 320. The sensing system is coupled to a controller 230, which calculates the thickness of the layer on the wafer 102 and determines locations of the thickness measurements. Eddy currents are induced and measured through holes or transparent areas 322, 324, and 326 within the polishing pad 300.

The carrier 200 illustrated in FIG. 1 has three concentric zones: a central zone 202, an intermediate zone 204, and a peripheral zone 206. A flexible membrane 208 provides a surface for supporting the wafer 102 while an inner ring 210 and an outer ring 212 provide barriers for separating the zones 202, 204, and 206. While three zones 202, 204, and 206 are illustrated in FIG. 1, any suitable number of zones may be used. The greater the number of zones, the more control over the planarization of the wafer surface may be exercised.

The carrier 200 is adapted to permit biasing the pressure exerted on different areas of the back surface of the wafer 102 by the zones. Areas on the back surface of the wafer 102 receiving a higher (or lower) pressure will typically increase (or decrease) the removal rate of material from corresponding areas on the front surface of the wafer 102. Removal rates of material from planarization processes are typically substantially uniform within concentric annular bands about the center of the wafer, but the carrier 200 is preferably capable of exerting different pressures in a plurality of different areas while maintaining a uniform pressure within each area. In addition, the carrier 200 also is able to apply different pressures over different zones on the back surface of the wafer.

The pressure within the central 202, intermediate 204, and peripheral 206 zones may be individually communicated through passageways 214, 216, 218 by respective controllable pressure regulators 220, 222, 224 connected to a pump 226. A rotary union 228 may be used in communicating the pressure from the pump 226 and pressure regulators 220, 222, 224 to their respective zones 202, 204, 206 if the carrier 200 is rotated. Controller 230 may be used to automate the selected pressure for each pressure regulator 220, 222, 224. Thus, each concentric zone 202, 204, 206 may be individually pressurized to create three concentric bands to press against the back surface of the wafer 102. Each zone 202, 204, 206 may therefore have a different pressure, but each concentric band will therefore have a uniform pressure within the band to press against the back surface of the wafer 102. In a closed-loop-control (CLC) system, the multi-probe thickness-measuring system 310 may be used to determine areas on the front surface of the wafer 102 that need an increase or decrease in material removal rate and, hence, an increase or decrease in pressures of the corresponding zones providing a process correction for a range of process variations.

Various devices may be used to track the location of the measurements on the front surface of the wafer 102. For example, an encoder 328 may be used to track the position of the carrier 200 (and thus the wafer) and transmit this information via communication line 330 to the controller 230. In a similar manner, an encoder 332 may be used to track the position of the supporting surface 302 (and thus the probes) and transmit this information via communication line 334 to the controller 230. The controller 230 thus has the information necessary to match the data from the multi-probe thickness-measuring system 310 with the data's corresponding location on the front surface of the wafer 102.

Figure 3:
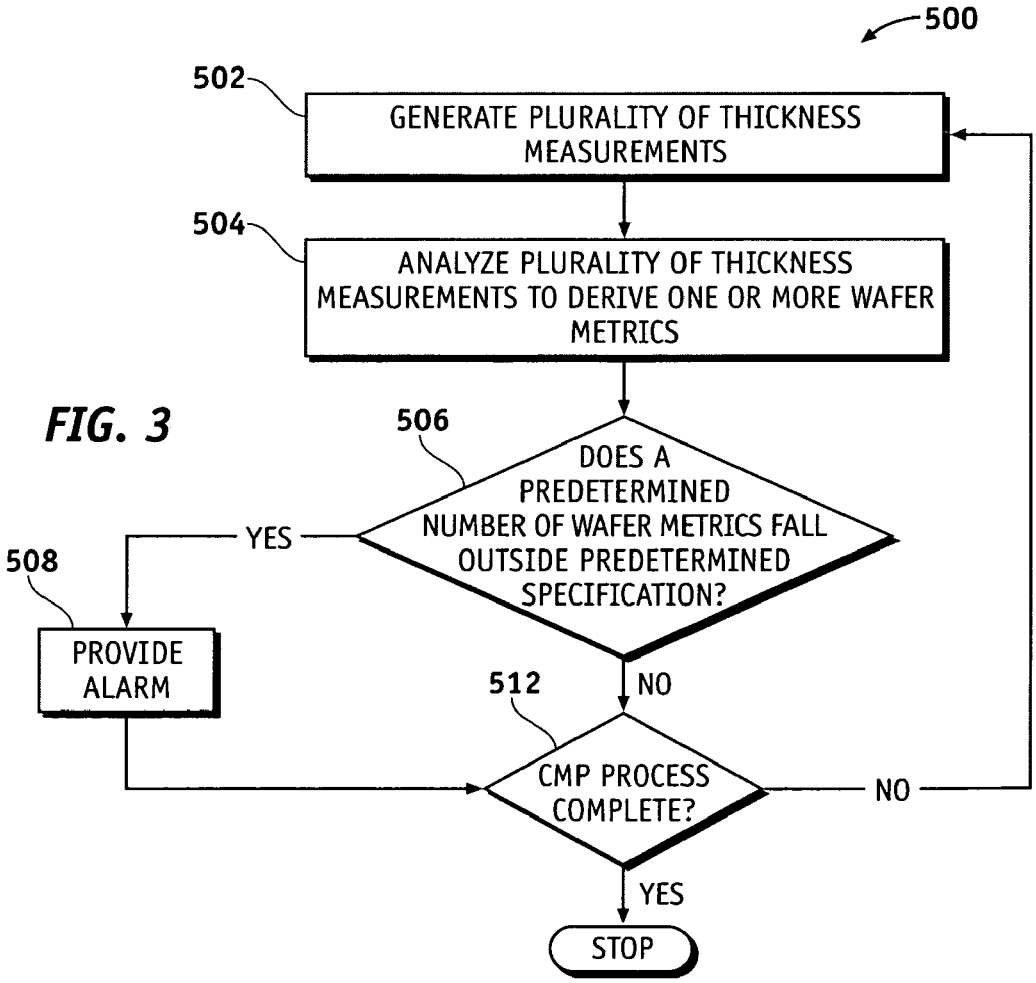
FIG. 3 is a flow chart of a method for monitoring a CMP process in accordance with an exemplary embodiment of the present invention.

Referring to FIG. 3, various exemplary embodiments of a method 500 for monitoring the removal of a metal layer from a work piece carrier during a CMP process now will be described. The method identifies errors or drifts in the CMP process or previously performed semiconductor processes, such as plating processes, that result in misprocessed wafers. In this regard, the CMP process or the previously performed processes can be immediately corrected, thus resulting in increased wafer production. The method may be performed by the controller 230 of the CMP apparatus 100 or any other automatic or manual means. The method 500 may begin after a work piece or wafer (hereinafter "wafer") is positioned in a carrier adjacent and substantially parallel to a working surface or polishing pad and a front surface of the wafer, that is, the surface of the wafer having a metal layer to be removed, contacts the polishing pad under pressure, preferably in the presence of a polishing solution or slurry.

The method 500 begins with the generation at a given time of the CMP process of a plurality of measurements of the thickness of the metal layer that is to be removed (step 502). In a preferred embodiment of the invention, the radial location of each of the thickness measurements also is determined. The thickness measurements then are analyzed to derive one or more sets of wafer metrics (step 504). For purposes of the present invention, the term "wafer metric", or "work piece metric", may include the thickness of the metal layer at a corresponding radial location, the average thickness across the wafer, and/or an average removal rate, such as an average removal rate of the metal layer within a zone of the carrier or an average removal rate of the metal layer across the entire wafer. The term "wafer metric" or "work piece metric" also may include a thickness profile of the metal layer prior to clearing of the metal layer. For example, the thickness profile of the metal layer may be determined for a specific average thickness or when any portion of the metal layer has less than a predetermined thickness, such as less than 1000 angstroms. In addition, the term "wafer metric" or "work piece metric" may include endpoint or transition times, that is, the amount of time for the planarization process to substantially remove the metal layer or the amount of time for the planarization process to remove a predetermined portion of the metal layer may be determined.

Moreover, the term "wafer metric" or "work piece metric" may include a "within wafer nonuniformity" (WIWNU) or a "wafer-to-wafer nonuniformity" (WTWNU). WIWNU is an acceptable deviation of a wafer metric within a wafer. In an exemplary embodiment, if the removal rate profile of a wafer is being monitored during the CMP process, the wafer metrics derived from the in-situ eddy current system's thickness measurements may include the average removal rate and its WIWNU, that is, its acceptable standard deviation ($\sigma$). In another exemplary embodiment, if the incoming thickness profile of a wafer is being monitored, the wafer metrics derived from the in-situ eddy current system's thickness measurements may include the average incoming thickness and its WIWNU. In yet another embodiment, if the thickness just prior to clearing is being monitored, the derived wafer metrics may include the average thickness of the material layer prior to clearing and its WIWNU.

WTWNU is an acceptable deviation of a wafer metric derived from a predetermined set of previously processed or measured wafers. The WTWNU is calculated from at least three wafers. For example, the WTWNU may be calculated from the first three processed wafers of a wafer set, from the first ten processed wafers of a wafer set, or a running WTWNU may be calculated, that is, the WTWNU may be calculated from a number of wafers just previously processed (e.g., last three wafers processed, last five wafers processed, etc.) For example, if the removal rate of the metal layer at the wafer edge is being monitored, the derived wafer metrics may include the WTWNU of the removal rate at a location at the wafer's edge. In another exemplary embodiment, if the endpoint times are being monitored, the derived wafer metrics may include the WTWNU of the end point times. Any other suitable measurable or analytically derived parameter that identified a condition of the wafer also may constitute a wafer or work piece metric. In addition, more than one type of wafer metric may be analyzed, either simultaneously or serially, to ensure that the CMP process or other related semiconductor processes are functionally correctly.

Once one or more sets of wafer metrics are derived, the wafer metrics are assessed to determine if a predetermined number, such as one, two, or more wafer metrics, falls outside of a predetermined specification (step 506). For example, if the wafer metric being analyzed is the average removal rate profile of the metal layer, a predetermined specification may be a range of acceptable average removal rates with a maximum and a minimum acceptable average rate. Optionally, or in addition, a predetermined specification may be an acceptable deviation from the WIWNU of the average removal rate (e.g., no more than $3\sigma$). In another example, if the wafer metric being analyzed is the average incoming thickness measurement of the material layer to be removed, a predetermined specification may be an acceptable thickness range. Optionally, or in addition, a predetermined specification may be an acceptable deviation from the WIWNU of the average incoming thickness.

If a predetermined number of wafer metrics of a set of wafer metrics is determined to be outside of a predetermined specification, a signal is provided to indicate that one or more semiconductor process parameters has drifted from or otherwise significantly varies from initial or desired semiconductor process parameters (step 508). In this regard, achieving a properly polished surface on the wafer is not likely. Accordingly, the CMP process may be terminated and/or one or more of the semiconductor process parameters may be corrected. In an exemplary embodiment of the invention, the signal may be any suitable visual or audible warning signal, such as a flashing light, a warning message, or a warning bell, whistle or horn, that informs a CMP operator that the CMP apparatus is not functioning correctly or optimally. The CMP operator may halt the CMP process and/or adjust the CMP process to correct for the drift or variance. Accordingly, the operator is given an opportunity to identify the wayward parameter(s) and make the appropriate correction(s). In another exemplary embodiment, a given signal also may be associated with each set of wafer metrics so that an operator can determine from the signal which wafer metric set has exceeded a desired specification. In an exemplary embodiment of the invention, each wafer metric set can be associated with a particular audible tone or with a visual message or color. For example, if the removal rate of the metal layer within only one pressure zone is outside the predetermined specification, the operator may determine from a first signal that the control of the pressure zones is working improperly and may fix the problem. In another example, if an incoming thickness of the metal layer at a location of the wafer is outside a WIWNU specification, the operator may determine from a second signal that a metal layer deposition process performed before the CMP process is improperly depositing metal and corrections can be made. Method 500 may be repeated any suitable number of cycles until desirable uniformity of the wafer surface is obtained and the CMP process is completed (step 512).

Figure 4:
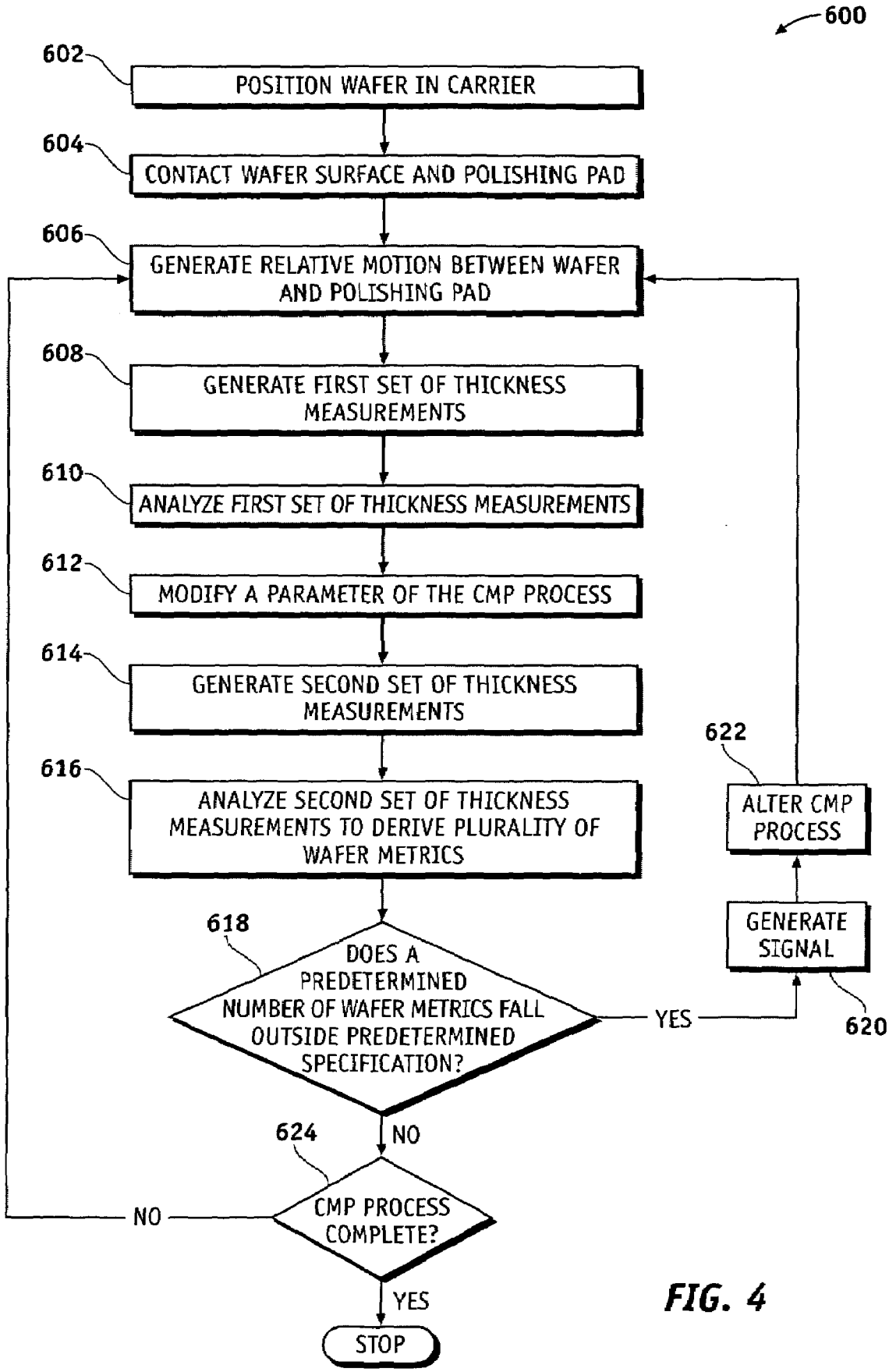
FIG. 4 is a flow chart of a method for monitoring a closed-loop-control (CLC) CMP process in accordance with another exemplary embodiment of the present invention.

Referring to FIG. 4, a method 600 in accordance with another exemplary embodiment of the invention utilizes steps of method 500 of FIG. 3 to monitor a closed-loop-control (CLC) CMP process. In this manner, any undercorrection or overcorrection by the CLC system can be identified and the process halted and/or amended so that the wafer being polished and any subsequent wafers are not misprocessed. The method 600 begins by positioning a wafer in the wafer carrier (step 602) and contact is made between the surface of the wafer to be polished (hereinafter "the front surface") and the working surface or polishing pad (step 604).

In an exemplary embodiment of the invention, once contact is made between the front surface of the wafer and the polishing pad, a first set of thickness measurements may be generated (step 608). In another exemplary embodiment of the invention, planarization may begin by generating relative motion between the front surface of the wafer and the polishing pad (step 606) and a first set of thickness measurements may be generated simultaneously with or subsequent to commencement of the planarization (step 608). By analyzing this first set of thickness measurements (step 610), a controller or processor of the closed-loop system may determine that corrections to a parameter of the CMP process should be made and cause the CMP apparatus to make such corrections (step 612).

Using method 500 of FIG. 3, a second set of thickness measurements are generated by the eddy current system (step 614) and are analyzed to determine a plurality of values of one or more sets of wafer metrics (step 616). Any of the wafer metrics described above for use in method 500 may be used in method 600 and one or more sets of wafer metrics may be utilized for each wafer processed. In an exemplary embodiment of the invention, the derived values of each of the sets of wafer metrics are assessed to determine if a predetermined number of them falls outside a predetermined specification (step 618). If the predetermined number falls outside the predetermined specification, a signal is generated to indicate that one or more semiconductor process parameters has drifted from or otherwise significantly varies from initial or desired semiconductor process parameters (step 620). Accordingly, the CMP process may be terminated and/or one or more of the semiconductor process parameters may be corrected by a CMP operator (step 622). As described above, in an exemplary embodiment of the invention, the signal may be any suitable visual or audible signal, such as a flashing light, a warning message, or a warning bell, whistle or horn, that informs a CMP operator that the CMP apparatus is not functioning correctly or optimally. In this regard, the CMP operator may terminate the CMP process and/or adjust the CMP process to correct for the drift or variance.

Once the CMP process has been corrected, steps 606–622 may be repeated any suitable number of cycles until it is determined that a desired surface will be achieved and/or until the CMP process is completed (step 624). In this regard, the CMP process can be monitored to ensure that the CLC system is not overcorrecting or undercorrecting the CMP process. In addition, the method of the present invention can be used to ensure that the CMP apparatus is operating correctly and optimally.

Accordingly, a method for monitoring the removal of a metal layer from work piece during a CMP process is provided. The method generates a signal when the CMP process "drifts", either during the planarization of a work piece or from work piece to work piece so that the process can be corrected. In this regard, the number of misprocessed wafers may be reduced, thus increasing product production. While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for monitoring the removal of a metal layer on the surface of a first work piece during a chemical mechanical planarization (CMP) process by a CMP apparatus, the method comprising the steps of:

generating a plurality of thickness measurements of the metal layer using an in-situ eddy current measuring system;

analyzing the plurality of thickness measurements to derive a plurality of first work piece metrics;

assessing whether a predetermined number of the plurality of first work piece metrics is within a first predetermined specification; and generating a first signal if the predetermined number of the plurality of first work piece metrics is outside the first predetermined specification.

2. The method of claim 1, further comprising the step of altering the CMP process upon generation of the signal.

3. The method of claim 2, further comprising the step of continuing to planarize the first work piece using the altered CMP process.

4. The method of claim 2, further comprising the step of planarizing a second work piece using the altered CMP process.

5. The method of claim 1, wherein the step of generating a signal comprises the step of generating a visual or audible signal.

6. The method of claim 1, further comprising the steps of:

analyzing the plurality of thickness measurements to derive a plurality of second work piece metrics;

assessing whether a predetermined number of the plurality of second work piece metrics is within a second predetermined specification; and generating a second signal if the predetermined number of the plurality of second work piece metrics is outside the second predetermined specification.

7. The method of claim 1, wherein the step of analyzing the plurality of thickness measurements to derive a plurality of first work piece metrics comprises the step of analyzing the plurality of thickness measurements to derive incoming thickness measurements of the material layer.

8. The method of claim 1, wherein the step of analyzing the plurality of thickness measurements to derive a plurality of first work piece metrics comprises the step of analyzing the plurality of thickness measurements to derive average removal rates of the material layer.

9. The method of claim 1, wherein the step of analyzing the plurality of thickness measurements to derive a plurality of first work piece metrics comprises the step of analyzing the plurality of thickness measurements to derive thickness measurements of the material layer prior to substantially removing the material layer from the work piece.

10. The method of claim 1, wherein the step of analyzing the plurality of thickness measurements to derive a plurality of first work piece metrics comprises the step of analyzing the plurality of thickness measurements to derive an endpoint time.

11. The method of claim 1, wherein the step of analyzing the plurality of thickness measurements to derive a plurality of first work piece metrics comprises the step of analyzing the plurality of thickness measurements to derive transition times to achieve a predetermined thickness of the material layer.

12. The method of claim 1, wherein the step of analyzing the plurality of thickness measurements to derive a plurality of first work piece metrics comprises the step of analyzing the plurality of thickness measurements to derive a within-wafer nonuniformity (WIWNU).

13. The method of claim 1, wherein the step of analyzing the plurality of thickness measurements to derive a plurality of first work piece metrics comprises the step of analyzing the plurality of thickness measurements to derive a wafer-to-wafer nonuniformity (WTWNU).

14. A method for chemical mechanical planarization of a first work piece, the method comprising the steps of:

polishing a metal layer on the first work piece by continuously contacting a surface of the metal layer with a working surface and generating relative motion between the surface of the material layer and the working surface;

inducing eddy currents within the metal layer;

measuring eddy current induced within the metal layer;

correlating the eddy current measurements with radial positions on the first work piece;

deriving a plurality of first work piece metrics based on the eddy current measurements and the radial positions thereof;

assessing whether a predetermined number of the plurality of first work piece metrics is within a first predetermined specification; and providing a signal if the predetermined number of the plurality of first work piece metrics is outside the first predetermined specification.

15. The method of claim 14, further comprising the step of halting the CMP process upon generation of the signal.

16. The method of claim 15, further comprising the step of altering the CMP process upon generation of the signal.

17. The method of claim 16, further comprising the step of continuing to planarize the first work piece using the altered CMP process.

18. The method of claim 16, further comprising the step of planarizing a second work piece using the altered CMP process.

19. The method of claim 14, further comprising the steps of:

deriving a plurality of second work piece metrics based on the eddy current measurements and the radial positions thereof;

assessing whether a predetermined number of the plurality of second work piece metrics is within a second predetermined specification; and providing a first signal if the predetermined number of the plurality of first work piece metrics is outside the first predetermined specification and providing a second signal if the predetermined number of the plurality of second work piece metrics is outside the second predetermined specification.

20. The method of claim 19, wherein the step of providing a signal comprises the step of providing a visual or audible signal.

21. A method for monitoring the removal of a metal layer on the surface of a work piece during a chemical mechanical planarization (CMP) process, the method comprising the steps of:

polishing the metal layer by continuously contacting a surface of the work piece with a working surface and generating relative motion between the wafer and the working surface;

generating a first set of measurements of a thickness of the metal layer;

analyzing the first set of measurements;

modifying a parameter of the CMP process based on the analysis of the first set of measurements;

generating a second set of measurements of the thickness of the metal layer;

deriving a plurality of work piece metrics from the second set of measurements;

assessing whether a predetermined number of the plurality of work piece metrics is within a predetermined specification; and providing a signal if a predetermined number of the plurality of work piece metrics is outside the predetermined specification.

* * * * *